US009437966B2

(12) United States Patent
Gagne et al.

(10) Patent No.: US 9,437,966 B2
(45) Date of Patent: Sep. 6, 2016

(54) ELECTRICAL CORD PLUG EJECT MECHANISM

(71) Applicant: Brainwave Research Corporation, Woodbridge, Ontario (CA)

(72) Inventors: Jean-Guy Gagne, Etobicoke (CA); James W. Rogers, Toronto (CA); Patrick Belanger, British Columbia (CA)

(73) Assignee: BRAINWAVE RESEARCH CORPORATION, Woodbridge (CA)

( * ) Notice: Subject to any disclaimer, the term of this patent is extended or adjusted under 35 U.S.C. 154(b) by 0 days.

(21) Appl. No.: 14/587,881

(22) Filed: Dec. 31, 2014

(65) Prior Publication Data

US 2015/0194763 A1 Jul. 9, 2015

Related U.S. Application Data

(60) Provisional application No. 62/043,091, filed on Aug. 28, 2014, provisional application No. 61/923,318, filed on Jan. 3, 2014.

(51) Int. Cl.

| | |
|---|---|
| ***H01R 13/62*** | (2006.01) |
| ***H01R 13/66*** | (2006.01) |
| ***H01R 13/70*** | (2006.01) |
| ***H01R 13/635*** | (2006.01) |
| ***H01R 13/713*** | (2006.01) |

(52) U.S. Cl.

CPC ..... *H01R 13/62* (2013.01); *H01R 13/635* (2013.01); *H01R 13/6691* (2013.01); *H01R 13/70* (2013.01); *H01R 13/7132* (2013.01)

(58) Field of Classification Search

USPC ..... 439/159, 160, 141, 158, 34, 132

See application file for complete search history.

(56) References Cited

U.S. PATENT DOCUMENTS

| | | | | |
|---|---|---|---|---|
| 2,688,734 | A * | 9/1954 | Welling | 439/159 |
| 3,475,715 | A * | 10/1969 | Venaleck | 439/159 |
| 3,784,958 | A * | 1/1974 | Harris | 439/159 |
| 3,922,600 | A * | 11/1975 | Roveti | 324/508 |
| 4,045,106 | A * | 8/1977 | Borg | 439/152 |
| 4,114,969 | A * | 9/1978 | Borg | 439/160 |
| 4,340,267 | A * | 7/1982 | Nukaga | 439/141 |
| 4,669,791 | A * | 6/1987 | Savill | 439/34 |

(Continued)

FOREIGN PATENT DOCUMENTS

DE 10260020 A1 7/2004

OTHER PUBLICATIONS

International Preliminary Report on Patentability for International Application No. PCT/CA2015/050001, mailed May 5, 2015, 3 Pages.

(Continued)

*Primary Examiner* — Alexander Gilman

(74) *Attorney, Agent, or Firm* — Ditthavong & Steiner, P.C.

(57) ABSTRACT

A plug housing includes an ejector mechanism and a controller electrically coupled to the ejector mechanism for detaching electrical conductive blades of the plug from a mated connection with a female connector. In response to a switch signal from the controller, a solenoid is activated to release a latch in the mechanism, thereby permitting the force of a compressed spring to impel a structure outwardly from the plug. The controller may be located remotely from the plug and superimpose control signals to the plug over the power lines within the cord.

5 Claims, 19 Drawing Sheets

(56) References Cited

U.S. PATENT DOCUMENTS

| | | | | |
|---|---|---|---|---|
| 5,266,040 | A * | 11/1993 | Merrill et al. | 439/159 |
| 5,480,313 | A * | 1/1996 | d'Alayer de Costemore d'Arc | 439/159 |
| 5,831,802 | A * | 11/1998 | Ahmed et al. | 361/1 |
| 6,062,883 | A * | 5/2000 | Schreiber et al. | 439/159 |
| 6,362,728 | B1 * | 3/2002 | Lace et al. | 340/426.11 |
| 6,540,533 | B1 * | 4/2003 | Schreiber | 439/159 |
| 7,344,393 | B2 * | 3/2008 | Buller et al. | 439/152 |

OTHER PUBLICATIONS

Written Opinion of The International Searching Authority for corresponding International Patent Application No. PCT/CA2015/050001 dated May 5, 2015, 4 Pages.

* cited by examiner

ELECTRICAL CORD PLUG EJECT MECHANISM

The benefit of provisional application 61/923,318, filed Jan. 3, 2014 and provisional application 62/043,091, filed Aug. 28, 2014, on behalf of inventors Jean-Guy Gagne and James Rogers, is claimed under 35 U.S.C. 119(e).

BACKGROUND

This disclosure is related to electrical cord and plug devices and, more particularly, to a mechanism for remotely controlling ejection of a plug from an outlet or from another cord or device to which the plug is connected.

A variety of electrical applications require a long electrical cord so that a user can operate an electrical appliance or other device at a relatively great distance from the power source. For example, vacuum cleaners are commonly provided with electrical cords that enable use over a large area, often extending to adjoining rooms. As another example, a long extension cord may be required for operation of a device at a location beyond the range of the cord originally provided with the device.

Upon completion of use, the operator typically needs to retrieve the connector plug for storage of the cord or for use of the device in another location. A pull on the cord by the user at the device location may not be sufficient to effect disconnection or, worse, damage the plug and outlet. Conventionally, disconnection of the plug from the power source occurs by the user physically traveling from the device to the remote location of the plug.

A need exists for removal of an electrical plug from connection to a power source by a user situated at a device location remote from the plug. A further need is the ability for a user to remotely control disconnection of the plug so that retrieval of the plug and cord can be accomplished at the device location. It may be desirable to remotely control both disconnection of the male plug of an extension cord from an outlet as well as disconnection of the female plug end of the extension cord from a user device. A further need exists for disconnection of a plug from an outlet in response to adverse conditions, such as an angular pull on the cord or overheating at the outlet.

SUMMARY OF DISCLOSURE

The needs described above are fulfilled, at least in part, by a plug housing including an ejector mechanism and a manual controller electrically coupled to the ejector mechanism for detaching electrical conductive blades of the plug from a mated connection with a female connector. In response to a switch signal from the controller, a solenoid is activated to release a latch in the mechanism, thereby permitting the force of a compressed spring to impel a structure outwardly from the plug.

The structure may be configured as a shell with one or more sections that surround the conductive blades. The latch may be composed of a plurality of latch elements. In the latched position, an inward end of the shell is positioned between the latch elements and the spring, within the plug housing. A second spring biases the latch elements toward the latched position.

The solenoid is positioned within the plug aligned in a direction in traverse of the direction of the axis of the plug. When energized, the solenoid overcomes the force of the second spring to provide space for the compressed spring to impel the shell outwardly. A circuit board within the plug provides contacts for electrical connection to the solenoid and the conductive blades. The circuit board also provides for circuit elements that receive and process a received controller signal.

The manual controller signal may be generated at the site of the plug or at a site remote from the plug. For example, a switch may be provided at the plug to complete a circuit to the solenoid. A switch may be provided at the far end of the cord or further along a connected power line. In response to switch deployment at the remote site, a communication signal is superimposed on the power lines for processing in the plug to cause solenoid energization. A tone generator may be included on the circuit board for processing a received analog signal, or a microcontroller may be included on the circuit board for processing a received data signal.

Alternatively, the solenoid may be positioned in the axial direction of the plug. The plunger of the solenoid is forced in the axial direction to unlatch the shell. In a further modification, the ejector structure may comprise an ejector plate having a surface area proximate the entire periphery of the plug housing. Holes in the surface surround the conductive blades. A rod extending inwardly from the ejector plate is fixed to an end of the solenoid plunger.

Additional advantages of the present disclosure will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF DRAWINGS

Various exemplary embodiments are illustrated by way of example, and not by way of limitation, in the figures of the accompanying drawings in which like reference numerals refer to similar elements and in which:

FIGS. 1*a* and 1*b* are isometric views of an electrical cord and plug ejecting mechanism in retracted position and ejected position, respectively;

FIG. 1*c* is a top view of the retracted male plug shown in FIG. 1*a;*

FIG. 1*d* is a section view taken from FIG. 1*c;*

FIG. 1*e* is a detail view taken from FIG. 1*d;*

FIG. 1*f* is a top view of the extended male plug shown in FIG. 1*b;*

FIG. 1*g* is a section view taken from FIG. 1*f;*

FIG. 1*h* is a detail view taken from FIG. 1*g;*

FIG. 1*i* is an isometric view of a plurality of plugs in serial connection;

FIGS. 2*a* is a top view of a retracted male plug;

FIG. 2*b* is a section view taken from FIG. 2*a;*

FIG. 2*c* is a detail view taken from FIG. 2*b;*

FIG. 2*d* is a top view of the male plug shown in FIG. 2*a* as extended;

FIG. 2*e* is a section view taken from FIG. 2*d;*

FIG. 2*f* is a detail view taken from FIG. 2*e;*

FIGS. 3*a* and 3*b* are isometric views of an electrical cord and plug ejecting mechanism in retracted position and ejected position, respectively;

FIG. 3*c* is a top view of the retracted male plug shown in FIG. 3*a;*

FIG. 3*d* is a section view taken from FIG. 3*c;*

FIG. 3*e* is a detail view taken from FIG. 3*d;*

FIG. 3*f* is a top view of the male plug shown in FIG. 3*a* as extended;

FIG. 3*g* is a section view taken from FIG. 3*f;*

FIG. 3*h* is a detail view taken from FIG. 3*g;*

FIGS. 7*a* and 7*b* are back and front isometric views, respectively, of a plug with ejector in retracted position;

FIGS. 7*c* and 7*d* are back and front isometric view, respectively, of a plug with ejector in extended position;

FIG. 7*e* is a top view of the device shown in FIGS. 7*a* and 7*b;*

FIG. 7*f* is a section view taken from FIG. 7*e;*

FIG. 7*g* is a section view taken from FIG. 7*f;*

FIG. 7*h* is a top view of the device shown in FIGS. 7*c* and 7*d;*

FIG. 7*i* is a section view taken from FIG. 7*h*; and

FIG. 7*j* is a detail view taken from FIG. 7*i;*

DETAILED DISCLOSURE

Figure 1A:
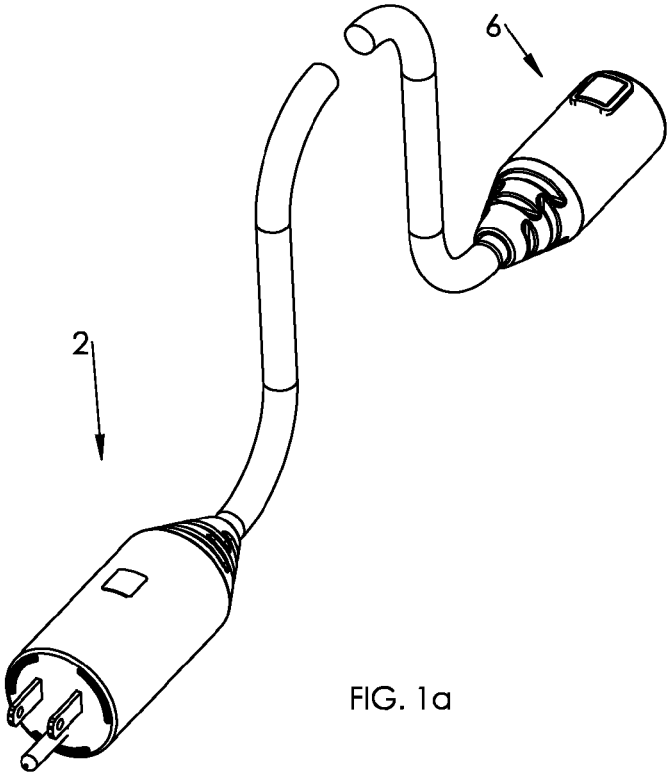
FIGS. 1*a*-1*i* are illustrative of an embodiment of the disclosure.
Figure 1B:
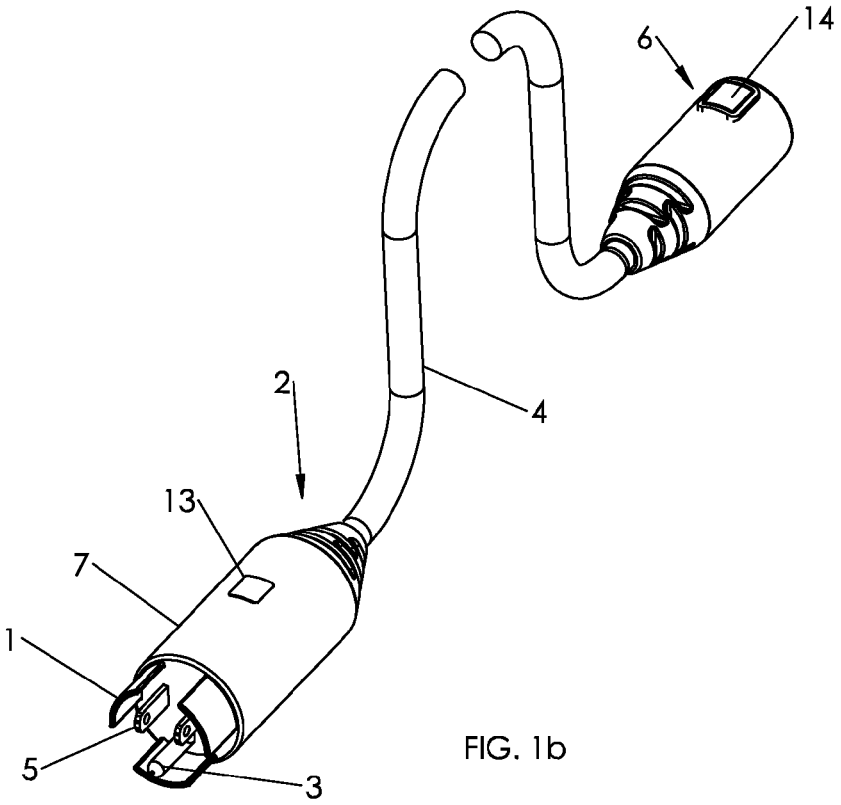
Figure 1C:
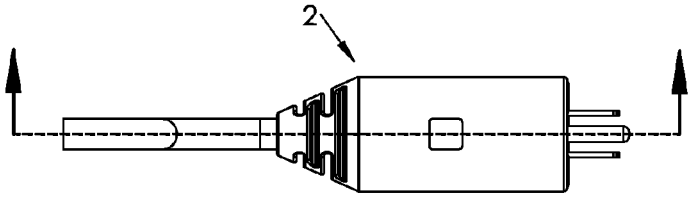
Figure 1D:
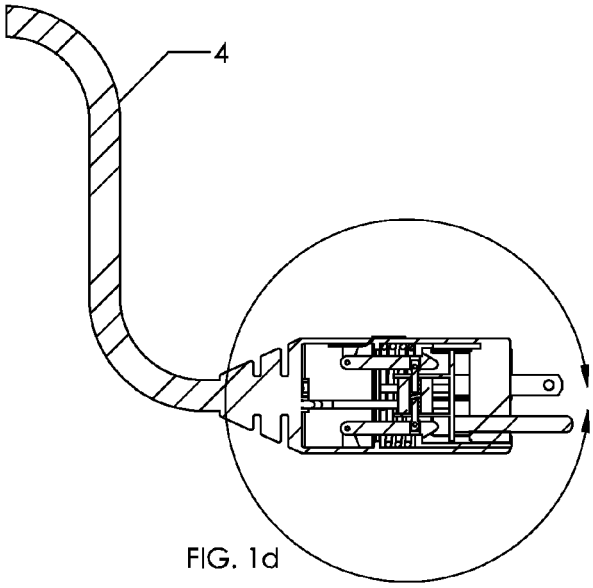

An electrical extension cord 2 having a cylindrical male plug 7 at one end and a female plug 6 is illustrated in FIGS. 1*a* and 1*b*. Conductive prongs 5 and ground prong 3 extend from plug 7. Shell 1, within plug 7, surrounds prongs 5. Shell 1 comprises sections formed in a cylindrical configuration with a surface area substantially corresponding in size to that of the circumference of the housing of plug 7. When shell 1 is retracted within plug 7, as shown in FIG. 1*a*, prongs 5 are able to mate with a female receptacle or plug to establish an electrical connection therewith. When shell 1 is extended from plug 7, as shown in FIG. 1*b*, a mated connection with plug 7 is precluded. Manual button 13 is tied to a switch component within plug 7. Manual button 14 is tied to a switch component within female plug 6. Components of plug 7 are shown in detail in FIG. 1*e* for the retracted position of shell 1 and in FIG. 1*h* for the extended position of shell 1. Depression of either button 13 or 14 effects ejection of plug 7 from the mated connection. Thus, ejection may be initiated at the connection site or initiated at the remote site of the female plug.

Figure 1E:
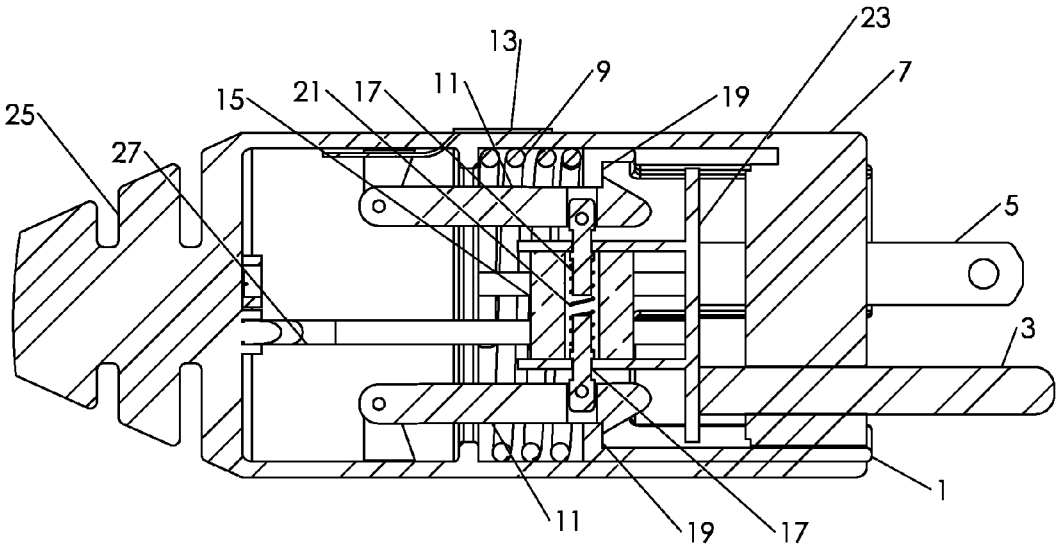
Figure 1F:
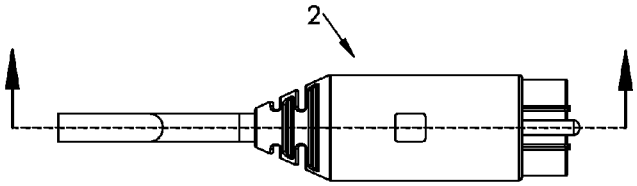
Figure 1G:
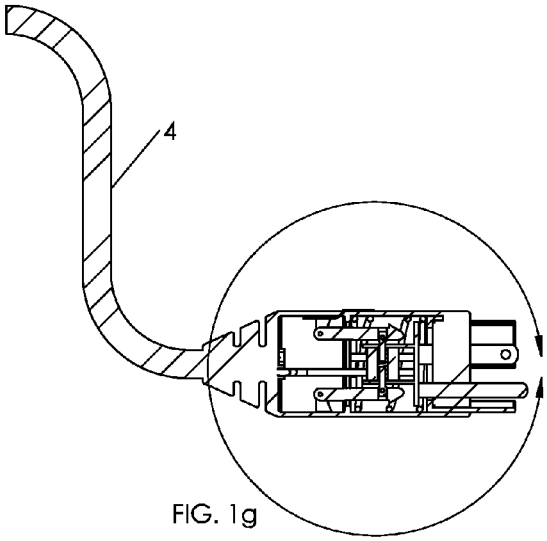
Figure 1H:
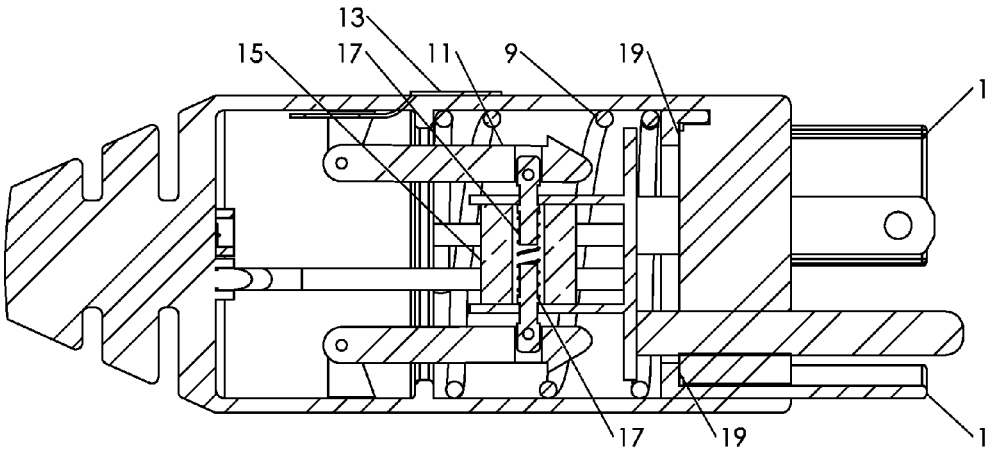

Referring to FIG. 1*e*, conducting wires and ground wires 27, only one of which is shown in the section, extend through strain relief 25, and are soldered to circuit board 23, the latter fixed within plug 7. Plug blades 5 and ground prong 3 are also mounted to circuit board 23, although they may alternatively be wired in a conventional manner. Solenoid 15, containing split plungers 17, is also mounted on circuit board 23. Windings of solenoid 15 are configured to pull plungers 17 toward each other when the solenoid is energized. Each plunger 17 is biased outwardly by spring 21 and pinned to an end of a respective latch 11. Latches 11 are also pinned to the outer structure of plug 7. Transverse surfaces 19 at the inward end of shell 1 are held in the retracted position by detents in latches 11 against the outward force of spring 9. As arranged in FIG. 1*a*, the plug may be inserted into a female receptacle for establishing electrical connection.

Shell 1, springs 9 and 21, solenoid 15, and latches 11 comprise an ejector mechanism for controlled removal of the plug from the electrical connection. Plug 7, in the ejected state, is shown in detail in FIG. 1*h*. In operation, ejection is activated by manual depression of button 13 of plug 7 or button 14 of plug 6. Deployment of each of these buttons effects a switched connection to energize solenoid 15. Armatures 17 overcome the outwardly biased force of spring 21, pulling latches 11 inward to clear the transverse surfaces 19 of shell 1. The expansion force of spring 9, unimpeded by latches 11, now impels shell 1 to its extended position, ejecting blades 5 and ground prong 3 from the mated connection. Solenoid 15 is de-energized pursuant the plug disconnection. Spring 21 again exerts sufficient force to return latches 11 to the initial position. The plug can be reinserted for a subsequent electrical connection. Shell 1 will be pushed inwardly against latches 11 to overcome the force of spring 9 until transverse surfaces 19 again are maintained by the latches.

Figure 1I:
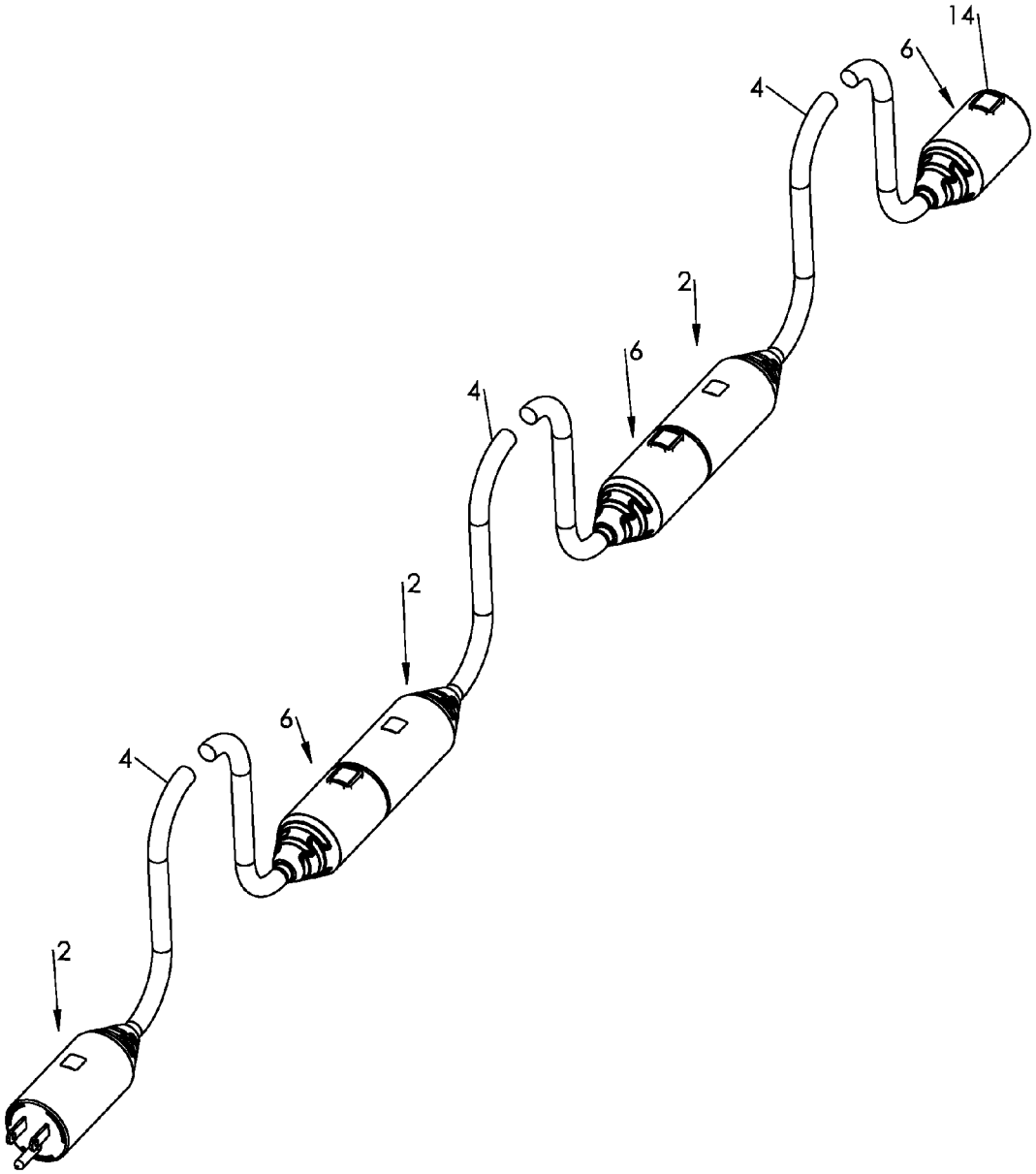

As shown in FIG. 1*i*, a plurality of electrical cords may be connected in series, the male plug of one cord connected to the female plug of the previous cord. The male plug of each cord may be embodied as shown in FIGS. 1*c*-1*h*. Any of the six switches in the plurality of cords illustrated may effect selective ejection of any or all of the male plugs. Selective remote ejector control is explained more fully below with respect to FIGS. 8-11.

FIGS. 2*a*-2*f* are directed to embodiment of the FIGS. 1*a*-1*h*, wherein the ejector release mechanism is modified. Components of plug 22 are shown in detail in FIG. 2*c* for the retracted position of shell 1 and in FIG. 2*f* for the extended position of shell 1.

Figure 2A:
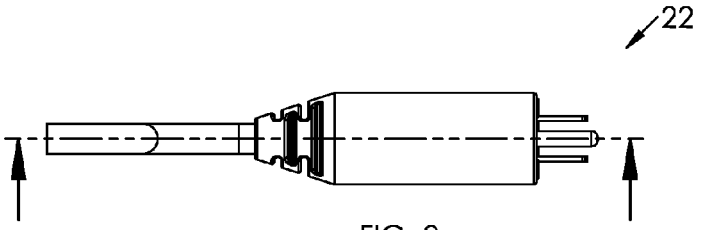
FIGS. 2*a*-2*f* are illustrative of a modification of the embodiment of the FIGS. 1*a*-1*h;*
Figure 2B:
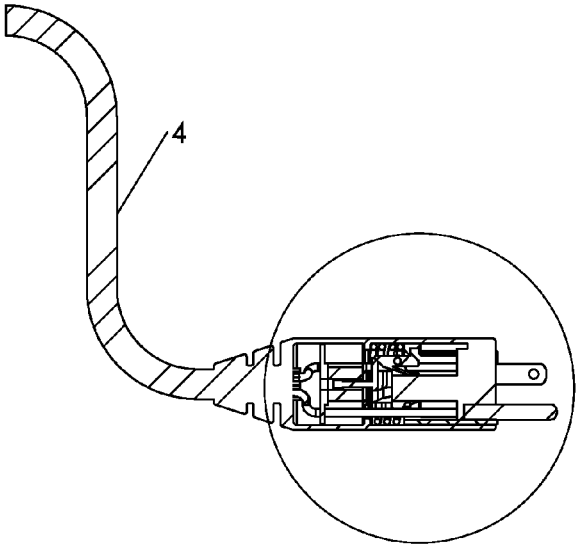
Figure 2C:
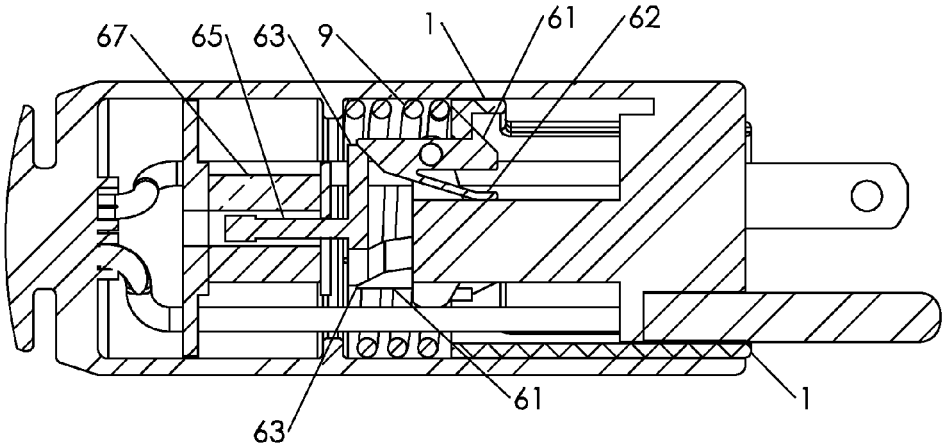
Figure 2D:
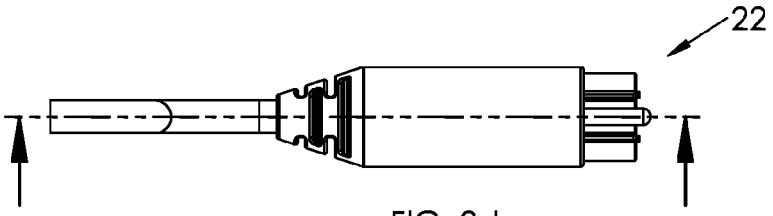
Figure 2E:
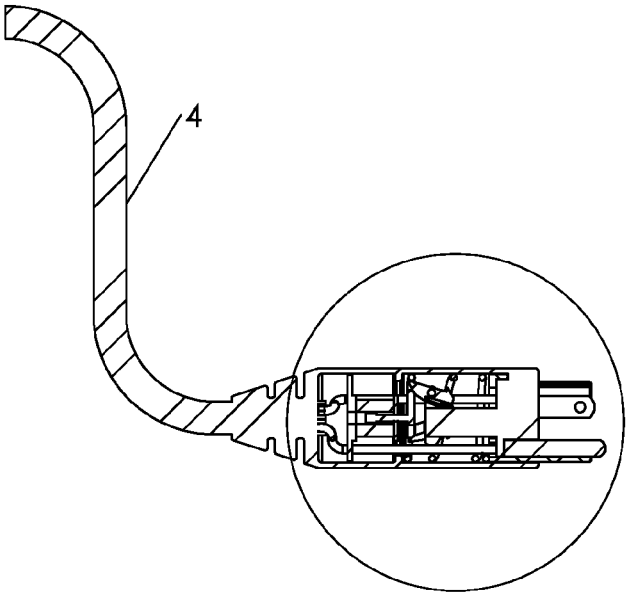

Referring to FIG. 2*c*, solenoid 67 is mounted concentrically within plug 22. Plunger 65 of solenoid 67 is shown positioned when the armature is not energized. Plunger elements 63, extending outwardly in the radial direction, rest against pinned latches 61. Transverse surfaces at the inward end of shell 1 are held in the retracted, or latched, position by latches 11 against the outward force of spring 9. Sprung elements 62 of the latches 61 maintain the pivoted latched positions of latches 61. As arranged in FIG. 2*c*, the plug may be inserted into a female receptacle for establishing electrical connection.

Figure 2F:
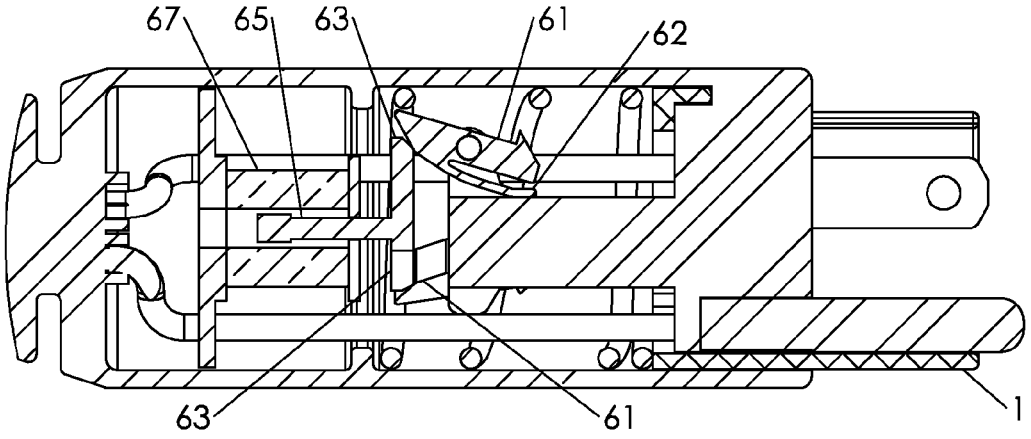

Plug 22, in the ejected state, is shown in detail in FIG. 2*f*. In operation, ejection is activated by manual depression of a switch, such as shown in FIGS. 1*a*, 1*b*, to effect a switched connection to energize solenoid 67. Plunger 65 is impelled in the axial direction toward latches 61. Plunger elements 63 force latches 61 to pivot until the latches disengage shell 1. The expansion force of spring 9, unimpeded by latches 61, now impels shell 1 to its extended position, ejecting blades 5 and ground prong 3 from the mated connection. Solenoid 65 is de-energized pursuant the plug disconnection. Sprung elements 62 ensure return of latches 61 to their initial position. The plug can be reinserted for a subsequent electrical connection. Shell 1 will be pushed inwardly against latches 11 to overcome the force of spring 9 until the transverse surfaces of shell 1 again are maintained by the latches.

Figure 3A:
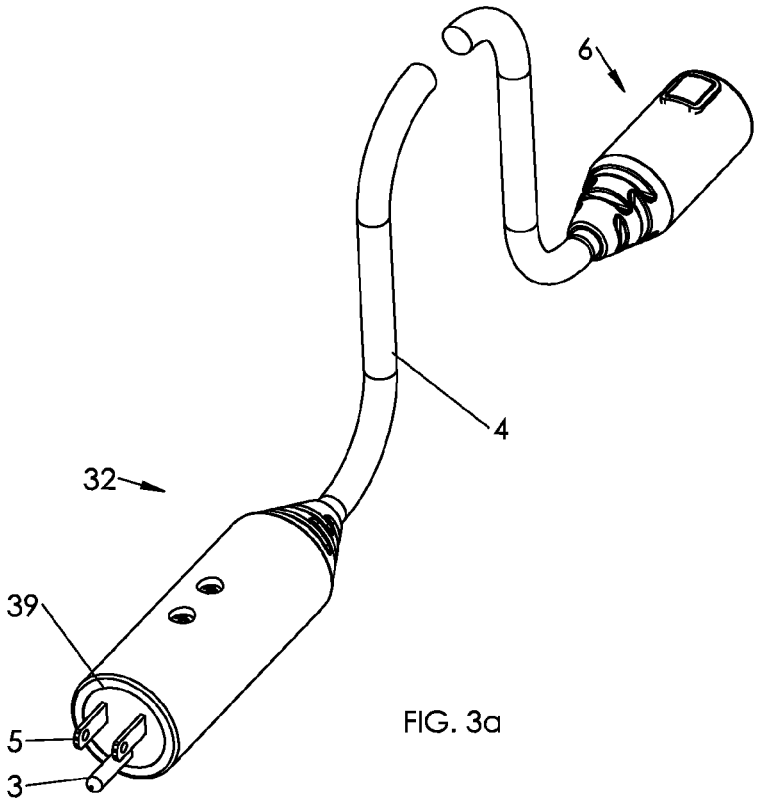
FIGS. 3*a*-3*h* are illustrative of a different modification of the embodiment of the FIGS. 1*a*-1*h;*
Figure 3B:
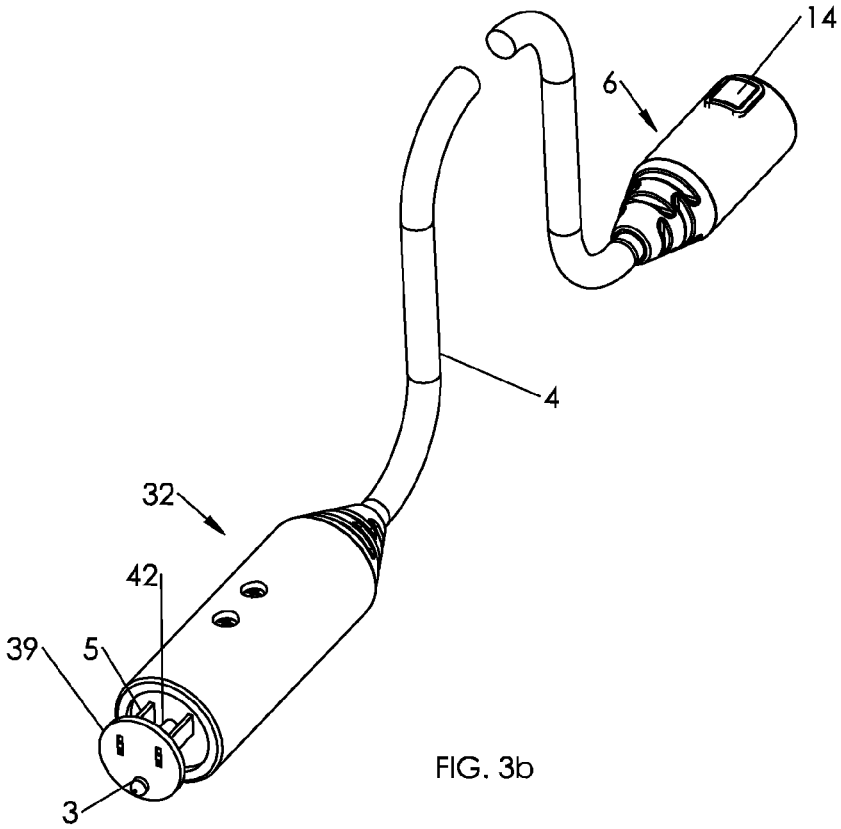
Figure 3C:
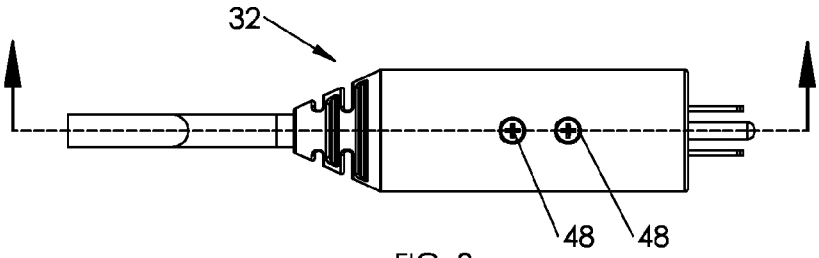
Figure 3D:
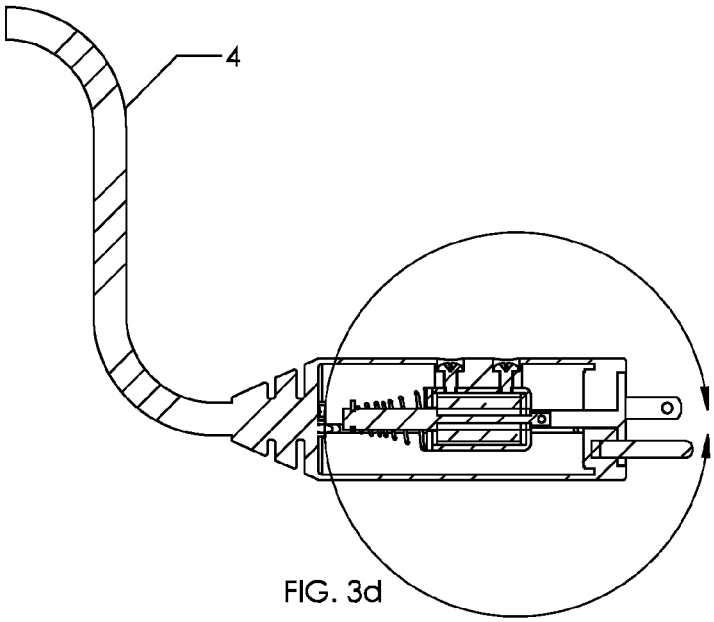

FIGS. 3*a*-3*h* are illustrative of an alternative embodiment. Extension cord 32, having a cylindrical male plug 7 at one end and a female plug 6 at the other, is illustrated in FIGS. 3*a* and 3*b*. Conductive prongs 5 and ground prong 3 extend from plug 7. Ejector plate 39, with appropriate openings for blades 5, surrounds prongs 5. When ejector plate 39 is retracted within plug 7, as shown in FIG. 3*a*, blades 5 are able to mate with a female receptacle or plug to establish an electrical connection therewith. When ejector plate 39 is extended from plug 7, as shown in FIG. 3*b*, a mated connection with plug 7 is precluded. Manual button 14 is tied to a switch component within plug 6. Components of plug 7 are shown in detail in FIG. 3*e* for the retracted position of ejector plate 39 and in FIG. 3*h* for the extended position of ejector plate 39.

Figure 3E:
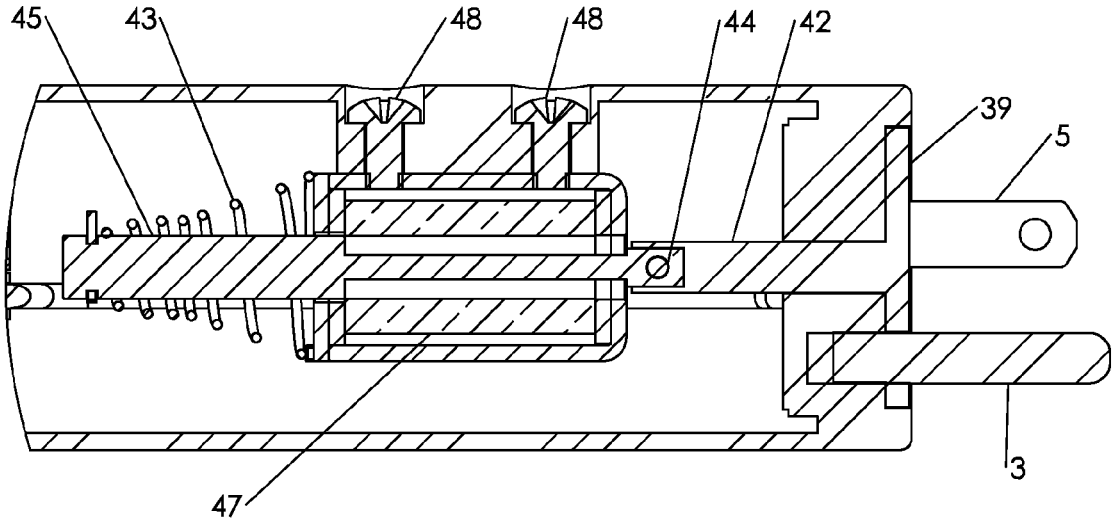
Figure 3F:
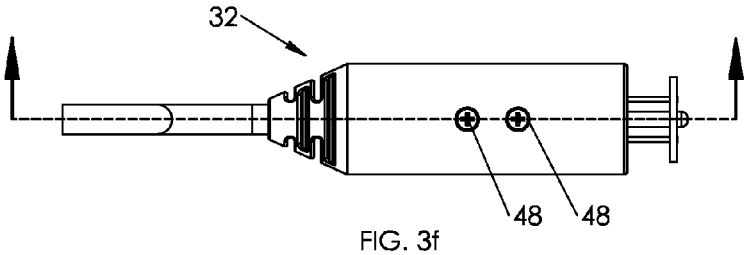
Figure 3G:
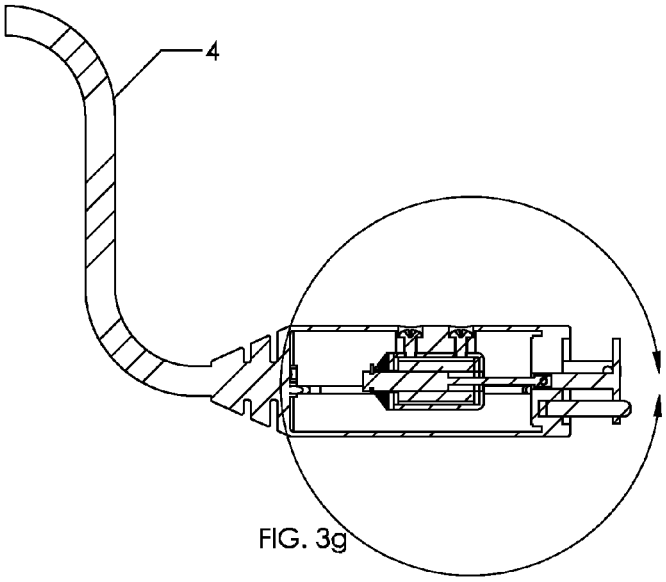

Referring to FIG. 3*e*, solenoid 47 is mounted concentrically within plug 7 by screws 48. Plunger 45 of solenoid 47 is shown positioned when the armature is not energized. Ejector plate 39 is fixed to plunger 45 by rod 42 and pin 44. Compression spring 43 is coupled between the fixed armature of solenoid 47 and plunger 45. As arranged in FIG. 3*e*, the plug may be inserted into a female receptacle for establishing electrical connection.

Figure 3H:
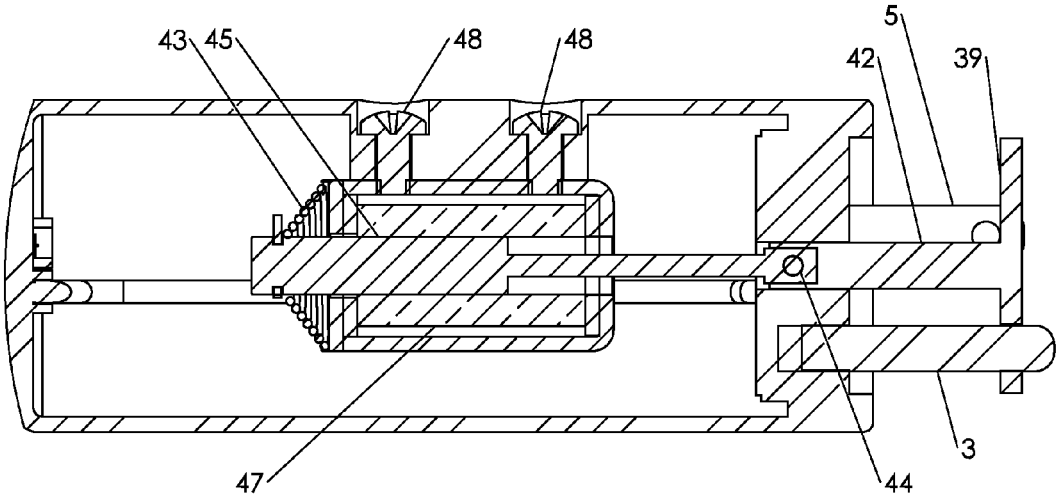

Plug 7, in the ejected state, is shown in detail in FIG. 3*h*. In operation, ejection is activated by manual depression of switch 14 to effect a switched connection to energize solenoid 47. Plunger 47 is impelled in the axial direction to drive rod 42 and ejector plate 39 to the extended position with enough force to eject blades 5 and ground plug 3 from the mated connection. Return spring 43 pulls plunger 47 back to the initial position after solenoid 47 is de-energized.

Figure 4:
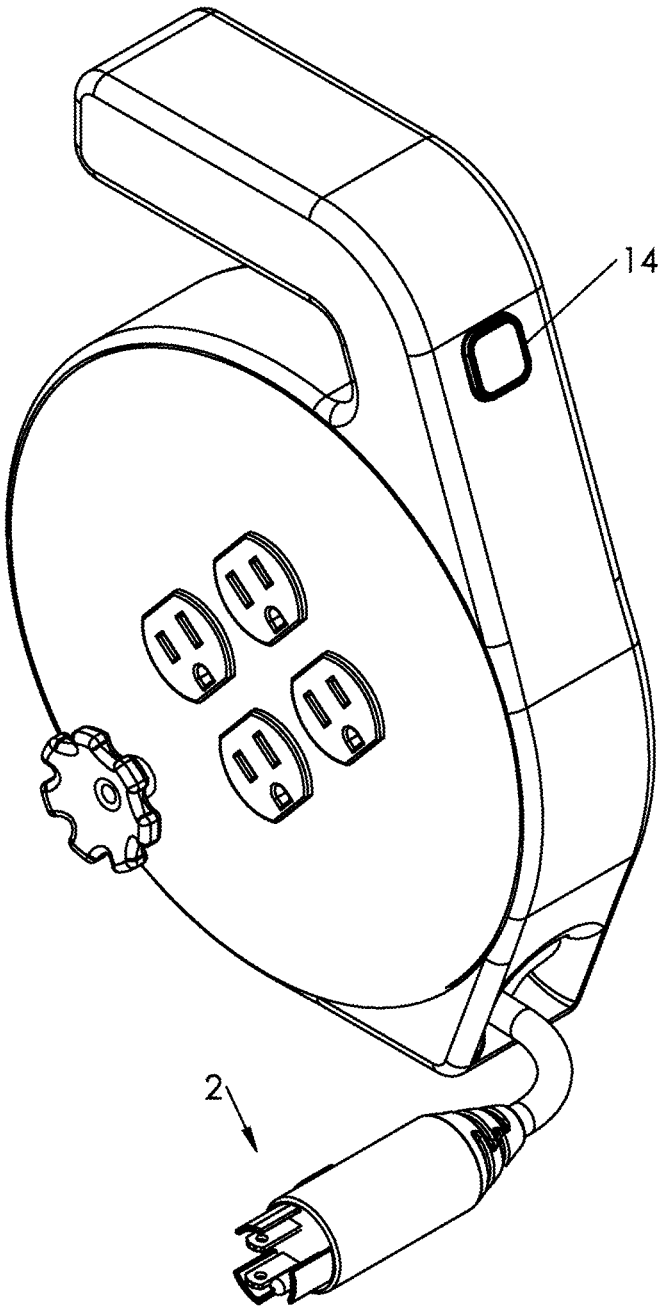
FIG. 4 is illustrative of an extended plug of FIGS. 1-3 incorporated in an extension cord reel.
Figure 5:
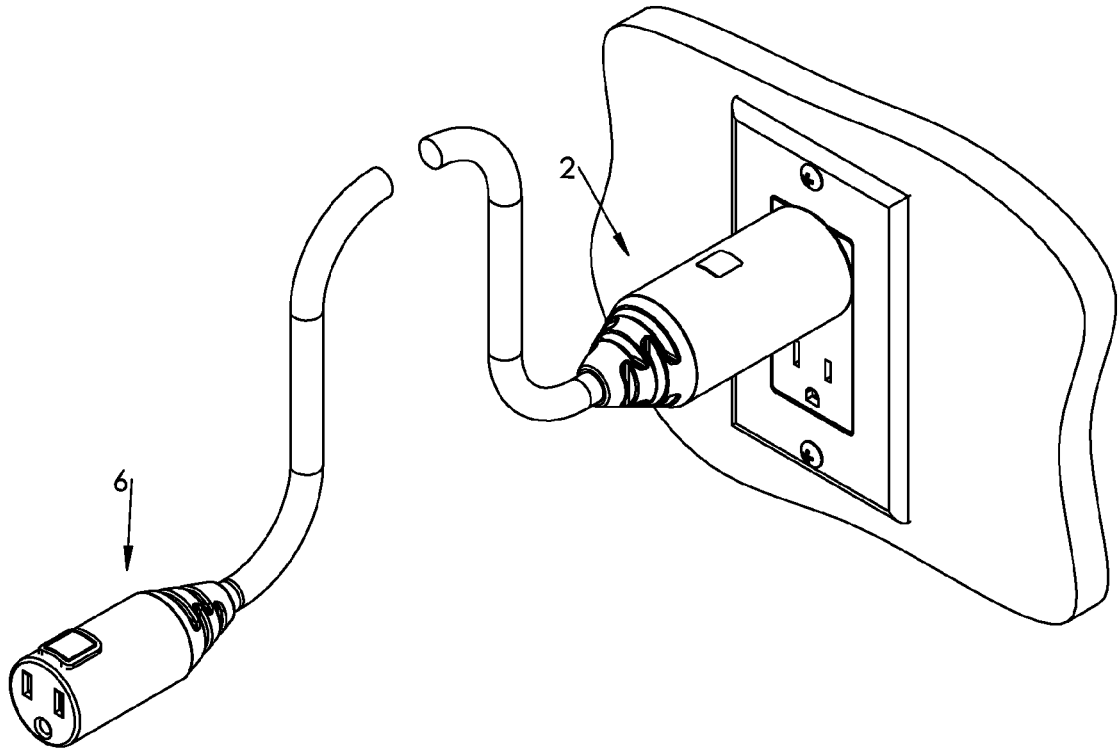
FIG. 5 is illustrative of a plug of FIGS. 1-3 connected with a wall outlet.
Figure 6:
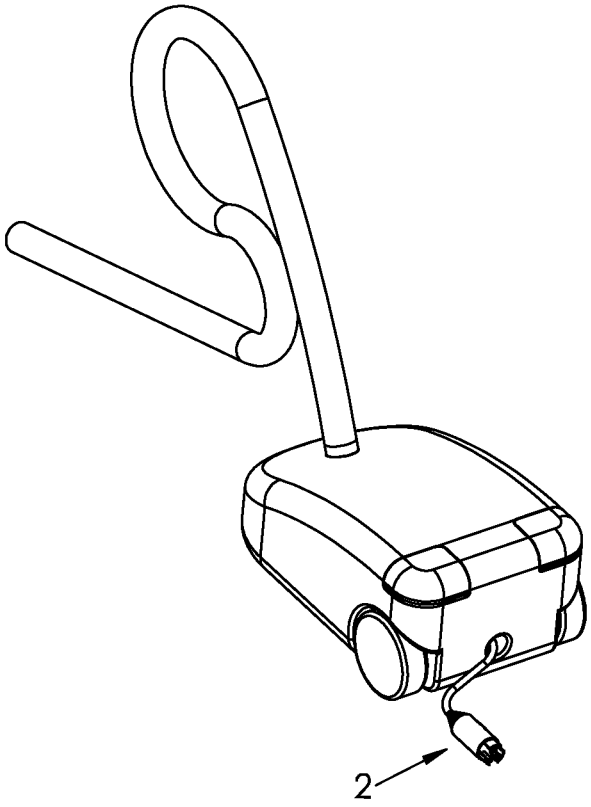
FIG. 6 is illustrative of an extended plug of FIGS. 1-3 incorporated in a vacuum cleaner.

FIGS. 4-6 illustrate examples in which plugs of this disclosure provide advantageous use. An extension cord reel is depicted in FIG. 4 with the cord reeled within its housing. The cord may be reeled out to mate with a female connector at any distance up to the length of the cord. Male plug 2 includes an ejector mechanism such as illustrated in FIGS. 1*a*-3*h*. Switch button 14, integrated in the reel housing, can be depressed to activate the male plug ejector mechanism to eject the plug from the mated connection. Such a connection may be made, for example, with a wall receptacle as shown in FIG. 5. Switch 14 may be incorporated with the cord reeling in functionality. FIG. 6 illustrates the ejector plug used to terminate a vacuum cleaner cord. An eject button may be incorporated in the housing or control arm.

FIGS. 7*a*-7*j* are illustrative of an alternative embodiment in which plug ejection occurs in response to inappropriate pulling of the cord. Male plug 68 is illustrated with shell 1 in retracted position in FIGS. 7*a* and 7*b*. Plug 68 is shown with shell 1 in extended position in FIGS. 7*c* and 7*d*. Components of plug 68 are shown in detail in FIG. 7*g* for the retracted position of shell 1 and in FIG. 7*j* for the extended position of shell 1.

Figure 7A:
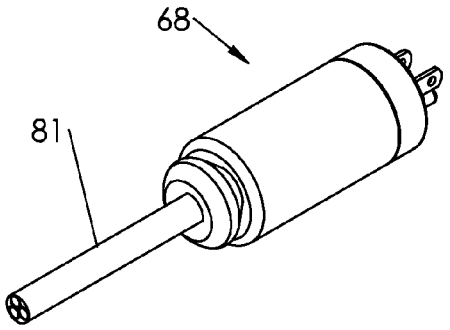
FIGS. 7*a*-7*j* are illustrative of another embodiment of the disclosure.
Figure 7B:
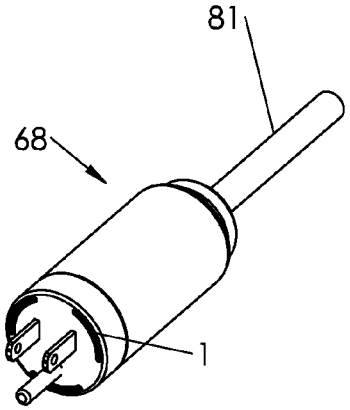
Figure 7C:
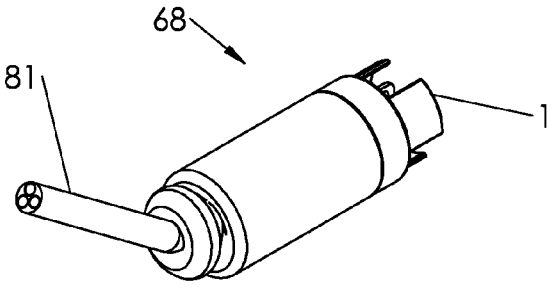
Figure 7D:
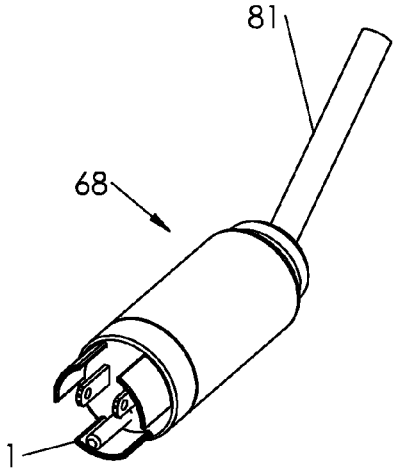
Figure 7E:
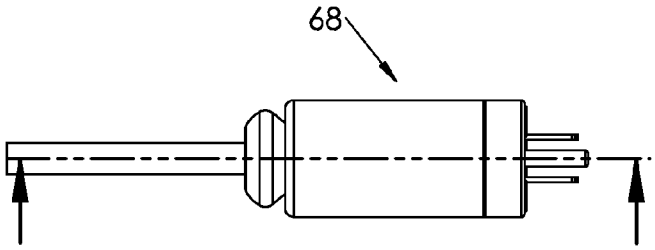
Figure 7F:
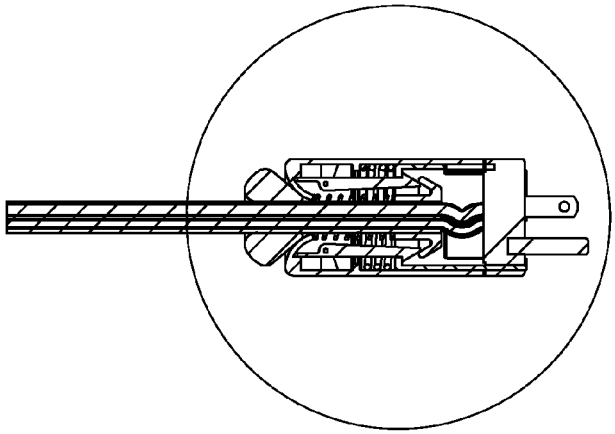
Figure 7G:
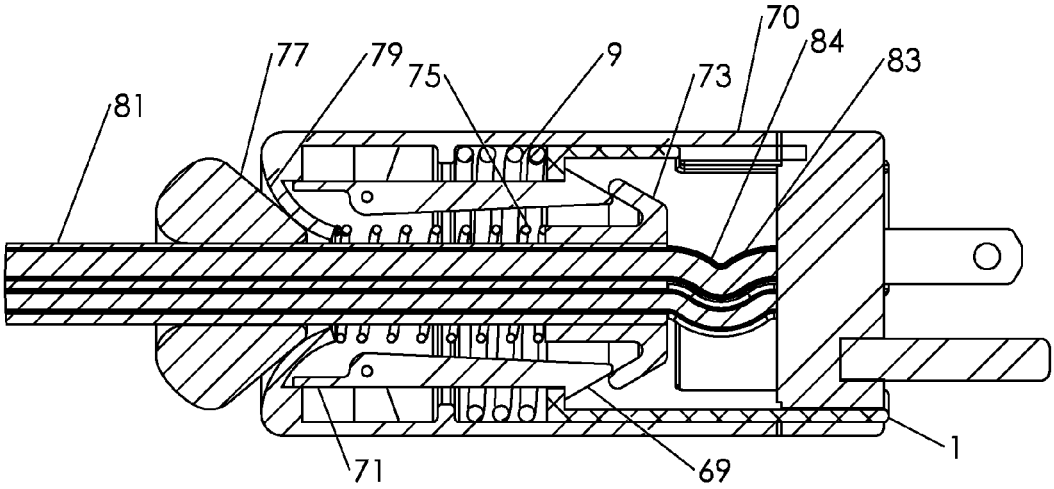
Figure 7H:
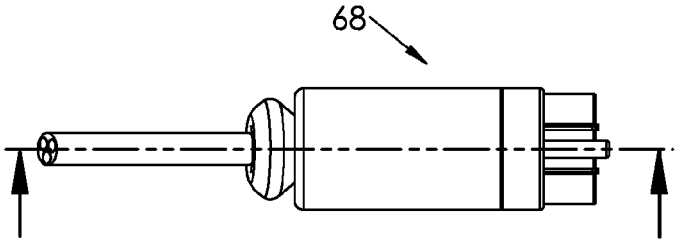
Figure 7I:
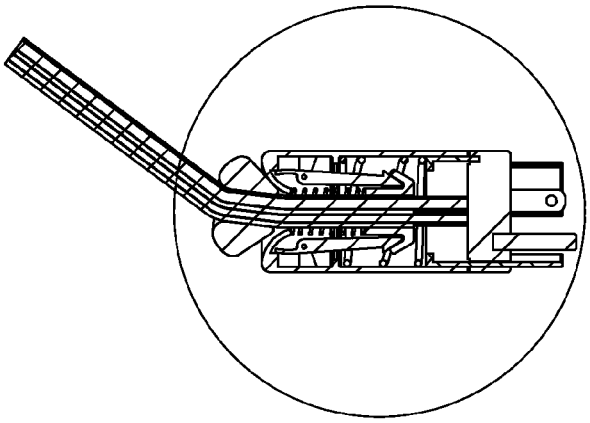
Figure 7J:
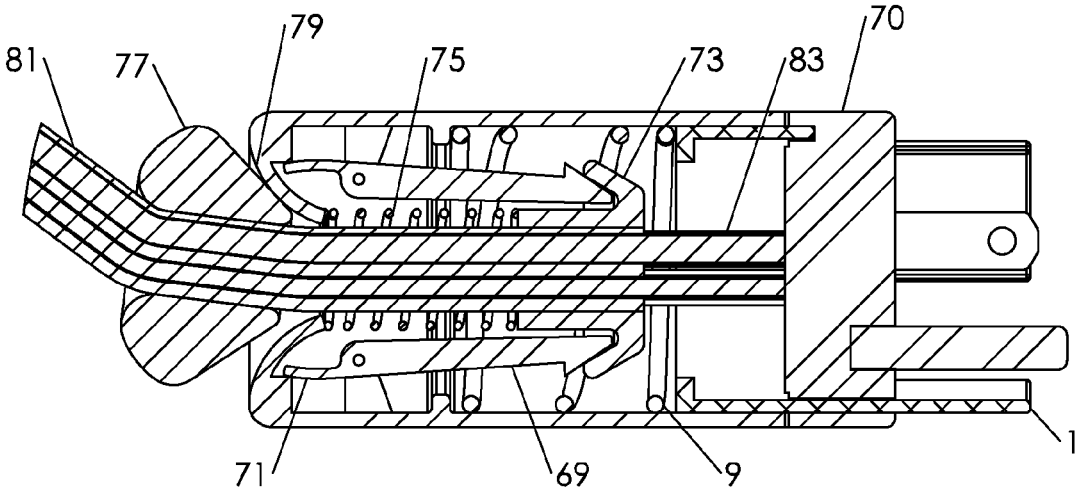

Referring to FIG. 7*g*, cable 81 is in-line with plug 68. Ejector 1 is retracted behind pinned latches 69. Spring 9 is held in compression. Latch release 73 is fixed on cord 81. Latch release 73 is held at a distance from rear portion 79 of the plug housing by latch spring 75. Cone 77, fixed to cord 81, abuts convex surface 79. A stripped portion 83 of cord 81 contains slack 84. An angled pull on cord 81, illustrated in FIGS. 7*c* and 7*d*, causes ejection of plug 68, the ejected state of the plug shown in FIG. 7*j*.

In operation, a pull on cord 81 at an angle to the central plug axis causes cone 77 to rotate on the convex surface 79 of plug housing 70. This rotation pulls on the cord to tighten slack 84. Latch release 73, fixed to cord 81 is pulled back over the ends of latches 69. Latches 69 to pivot toward the central axis against the bias force of spring 75 until shell 1 is free under the ejection force of spring 9. The unlatched shell 1 is then forced into the ejected position by spring 9.

Ejection of the plugs illustrated in FIGS. 1*a*-3*h* may be made under remote selective control. Solenoid activation is achieved through signaling over the typical current carrying conductors of the cord itself without the need for a third wire. Such operation is described with reference to FIGS. 8-11.

Figure 8:
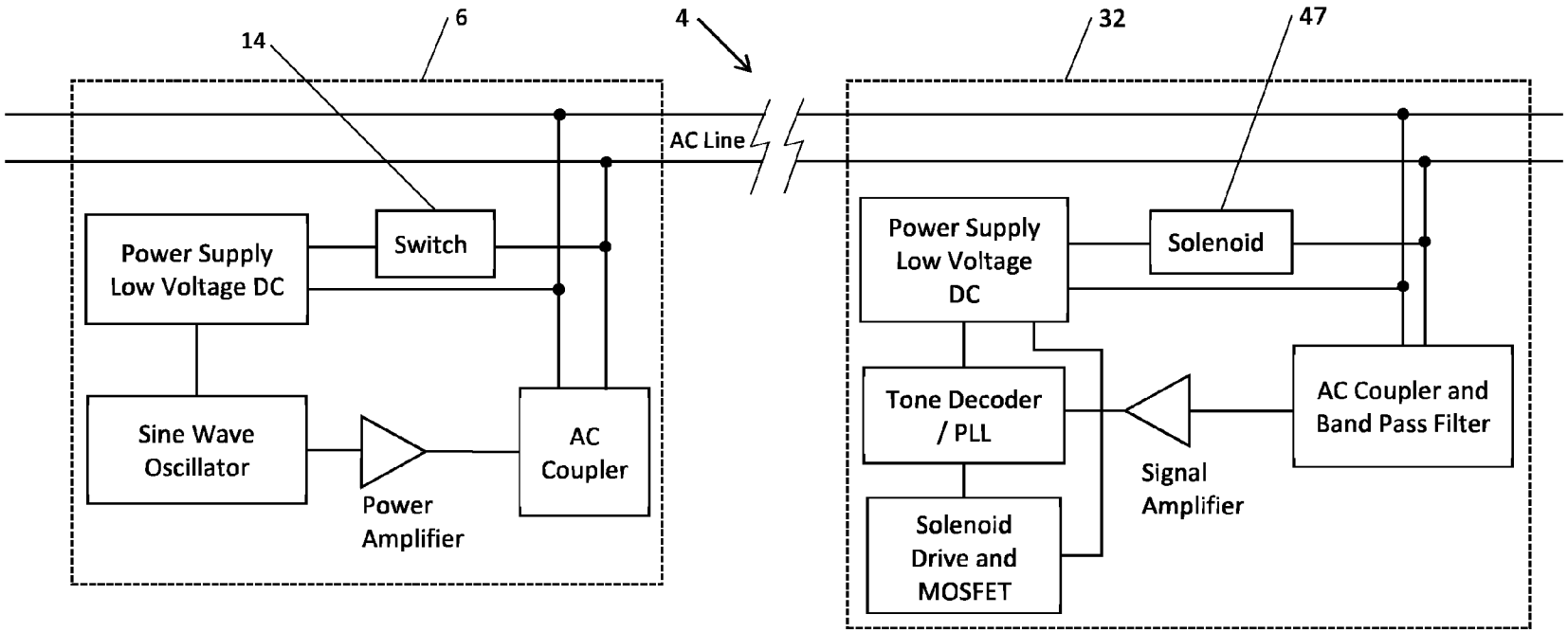
FIG. 8 is a block diagram of circuit elements of plug units for ejection under analog control.

FIG. 8 is a block diagram of the electrical elements of male ejector plug 32 and female plug 6. It should be understood that the elements of block 6 may, instead, be incorporated in a user device such as the illustrated vacuum cleaner. The control circuits of the two plugs are coupled to each other solely by analog tone communication over the a-c power line conductors 4.

As shown in block 6, serial connection of switch 14 and low voltage d-c power supply are connected across line conductors 4. The d-c power supply is dormant when the switch is in the open state. Depression of switch 14 completes connection of the d-c power supply 4, which is then activated to power the sine wave oscillator. The oscillator output is then amplified and coupled to the a-c coupler to be superimposed on power line conductors 4. The sine wave oscillator may be selectively adjustable to output a desired frequency tone.

As shown in block 32, serial connection of solenoid 47 and low voltage d-c power supply are connected across line conductors 4. An a-c coupler/band pass filter is connected to lines 4 to output the superimposed signal received over line 4 from block 6 when switch 14 is in the closed state. The signal output is amplified and applied to the tone decoder. Solenoid drive and MOSFET circuit and the tone decoder are powered by the low voltage power supply. Upon receipt of the amplified filtered signal the tone decoder applies an output to the solenoid drive circuit to activate the solenoid. Ejection of the plug 32 is then initiated.

The tone decoder may be responsive to a range of signal frequencies or limited in response to a specific tone frequency. In the latter case, plug 32 is associated with a unique identifier frequency that must be paired with the same frequency output by the sine wave oscillator of block 6. In the case of a plurality of serially connected cords, such as illustrated in FIG. 1*c*, each male plug has a specific identifier. For remote ejector operation, switch 14 may be paired with the particular plug selected by outputting the oscillator signal at the frequency paired for that plug. If ejection of a plurality of plugs, the oscillator may set to output a range of frequencies pairing each of the plugs. When an eject button is depressed all plugs that have been paired with it will eject if they are on the same electrical circuit.

Figure 9:
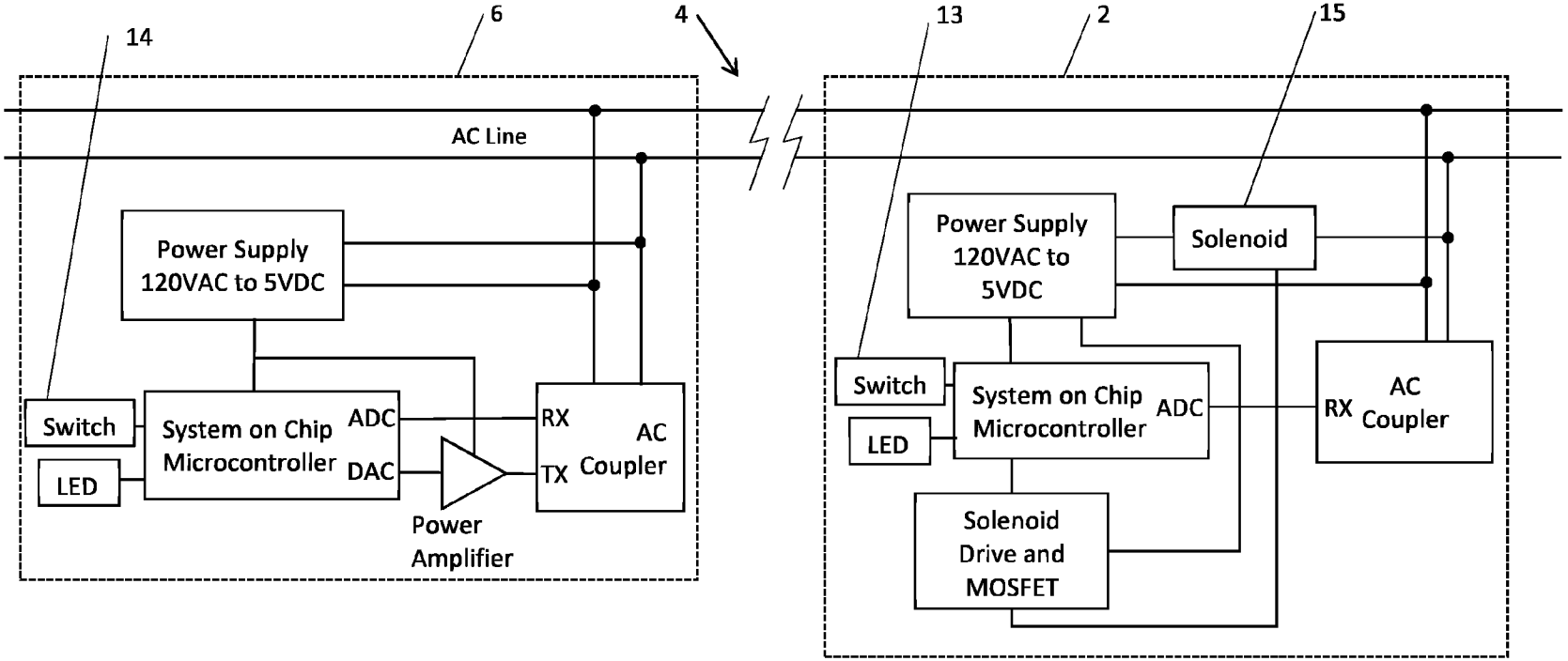
FIG. 9 is a block diagram of circuit elements of plug units for ejection under digital control.

FIG. 9 is a block diagram for digital control of plug ejection, containing digital counterparts of the analog elements of FIG. 8. A-c to low voltage d-c power supply is shown connected across a-c line 4 in block 6. The microcontroller is responsive to a signal from switch 14 to output a signal to the LED. Data outputs are applied by the microcontroller to the power amplifier and AC coupler. The data signal is superimposed on output line 4 by the a-c coupler. Plug 2 contains a microcontroller having an input connected to the a-c coupler. The a-c coupler is connected to the input lines 4 and filters out the a-c component input from lines 4. The microcontroller, powered by the low voltage supply, is responsive to a data signal received from the a-c coupler to activate solenoid 15 if the data signal matches a unique identifier of the plug 6. That is, solenoid activation occurs when the output of block 6 is paired with the data stored on the microcontroller chip.

Figure 10:
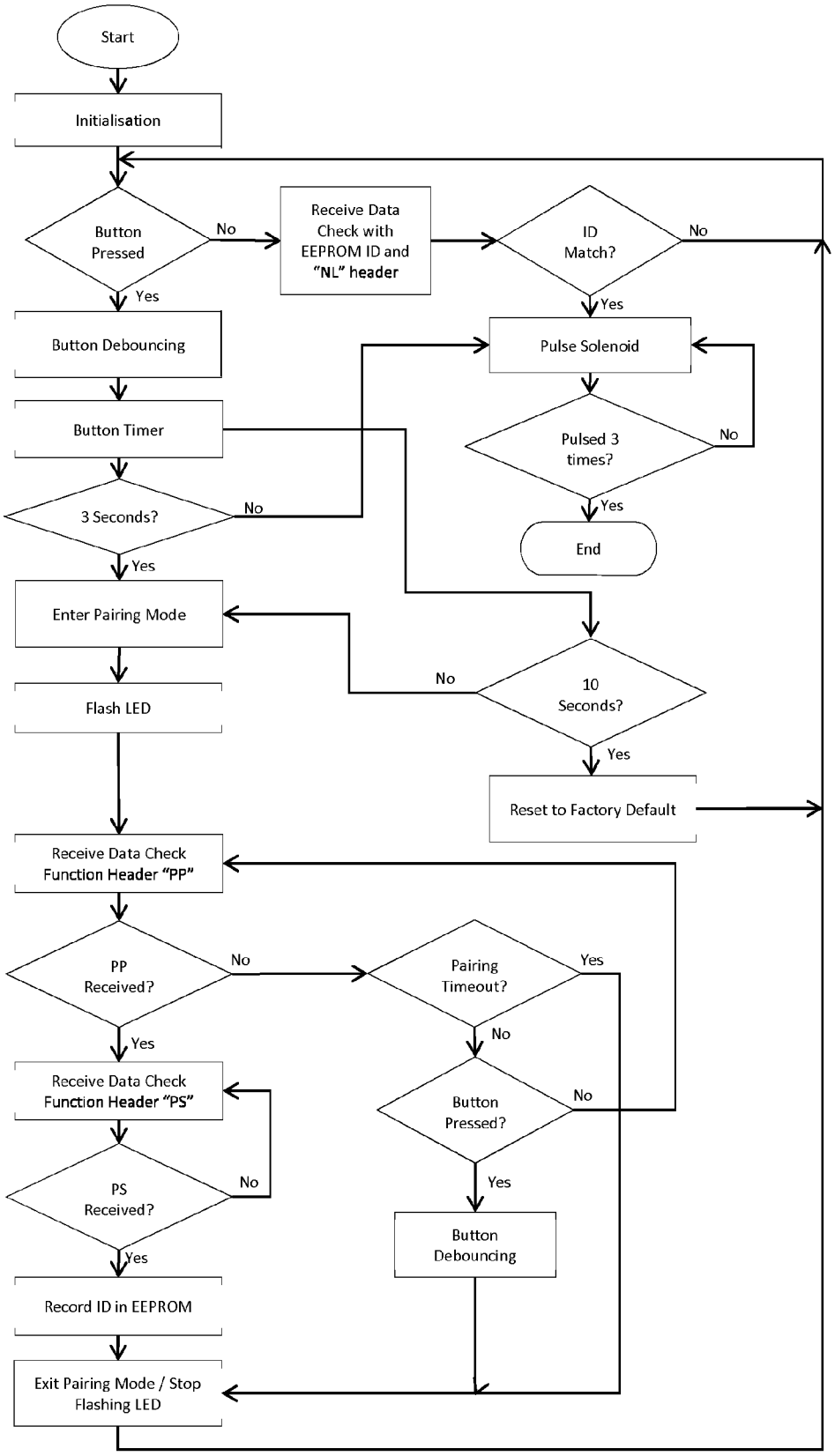
FIGS. 10 and 11 are flow charts of operation for the block diagram elements of FIGS. 8 and 9.
Figure 11:
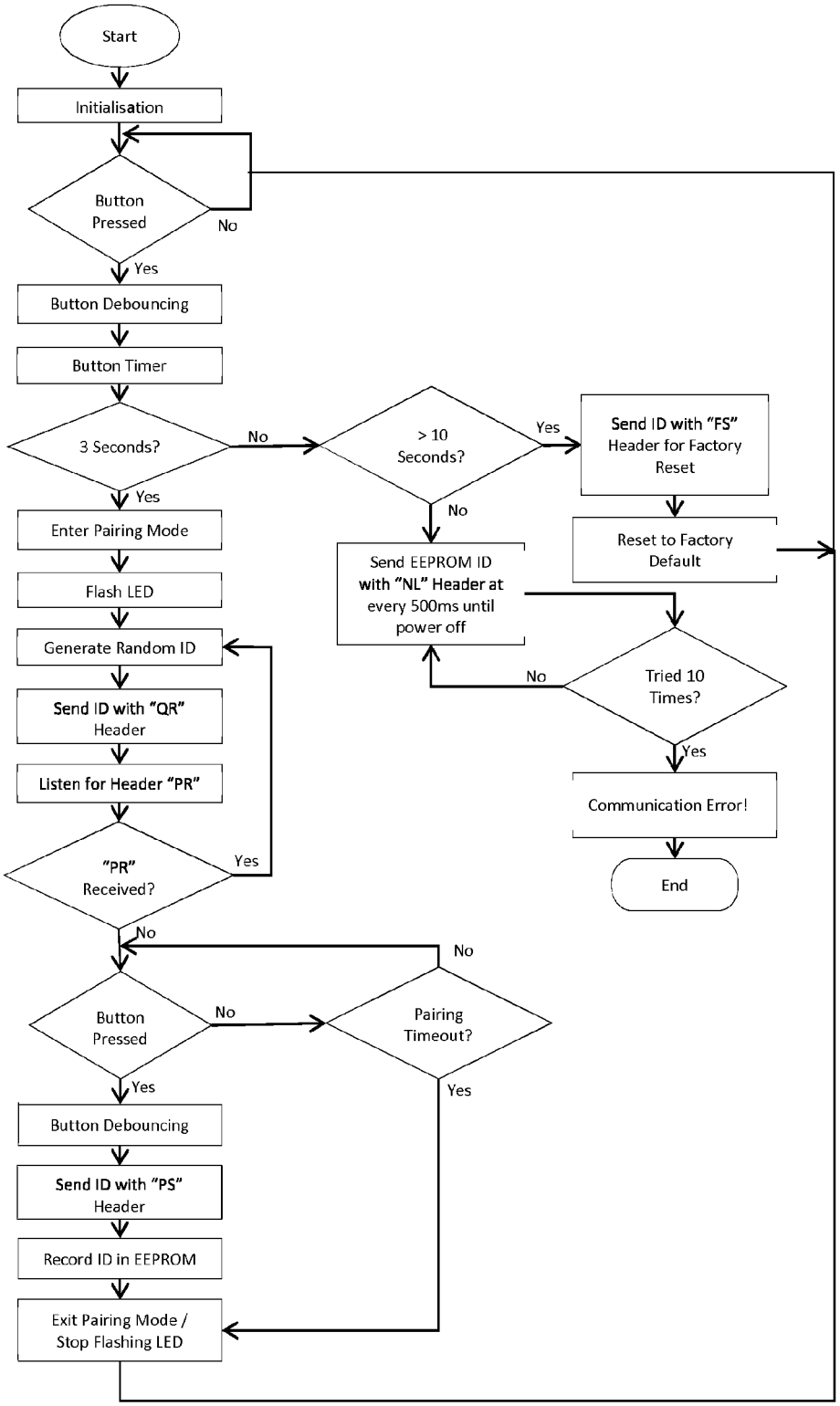

FIG. 10 is a flowchart for the ejection process. FIG. 11 is a flowchart for the pairing process.

In this disclosure there are shown and described only preferred embodiments of the invention and but a few examples of its versatility. It is to be understood that the invention is capable of use in various other combinations and environments and is capable of changes or modifications within the scope of the inventive concept as expressed herein. For example, the diameter of the plug and diameter of the ejector can be increased to allow the ejector to contact the faceplate of a receptacle to further distribute the force of the ejection.

Additionally, the concepts of the present disclosure is not limited to a specific number of alternating current contact blades and may further be applicable to direct current plug devices.

Generation and processing of communication signals may be implemented in accordance with any of known communication protocols. It is further envisioned that wireless signaling technology may be utilized.

What is claimed is:

1. An electrical device comprising:

a plug housing comprising a plurality of conductive blades connected to respective wires of an electrical cord, and an ejector mechanism; and a controller connected to the cord, the controller electrically coupled to the ejector mechanism; wherein;

the controller is located at a remote distance from the plug housing; and the ejector mechanism comprises:

a shell circumferentially surrounding the conductive blades;

a spring coaxial with the plug housing; and a latch, an end portion of the shell is positioned between the latch and the spring to maintain the shell within the plug housing, and wherein the shell comprises a plurality of individually spaced sections along the shell circumference, spaces between the sections exposing the conductive blades.

2. An electrical device as recited in claim 1, wherein the ejector mechanism further comprises:

a solenoid having an axis traverse to the axial direction of the plug housing and a plunger pivotally attached to the latch;

wherein energization of the solenoid forces release of the latch from the shell to apply an ejection force of the spring to the shell.

3. An electrical device as recited in claim 2, wherein the ejector mechanism further comprises a second spring oriented in the transverse direction, the second spring biasing the latch to a position between the cylindrical spring and the shell.

4. An electrical device as recited in claim 3, wherein the latch comprises a plurality of latch elements, biased away from each other by the second spring.

5. An electrical device as recited in 2, wherein the plug housing further includes a circuit board to which the blades are connected.

* * * * *